United States Patent [19]

Fleissner

[11] Patent Number: 4,959,948

[45] Date of Patent: Oct. 2, 1990

[54] FIBER BALING PRESS

[75] Inventor: Gerold Fleissner, Chur, Switzerland

[73] Assignee: Fleissner Machinenfabrik AG, Rebstein/Schweiz, Fed. Rep. of Germany

[21] Appl. No.: 249,296

[22] Filed: Sep. 26, 1988

[30] Foreign Application Priority Data

Sep. 25, 1987 [DE] Fed. Rep. of Germany ..... 3732390

[51] Int. Cl.[5] ..... B65B 1/26; B65B 13/20; B30B 5/00

[52] U.S. Cl. ..... 53/528; 100/240

[58] Field of Search ..... 53/218, 221, 222, 397, 53/436, 464, 528, 580, 579; 100/240, 241, 246, 252, 253, 3

[56] References Cited

U.S. PATENT DOCUMENTS

| | | | |
|---|---|---|---|
| 159,378 | 2/1875 | Baldwin | 100/3 |
| 1,840,053 | 1/1932 | Prince | 53/464 X |
| 2,621,589 | 12/1952 | Dubois | 53/528 X |
| 2,731,777 | 1/1956 | Wollersheim | 53/436 |
| 2,790,287 | 4/1957 | Kraft et al. | 53/579 X |
| 3,246,443 | 4/1966 | Slemmons | 53/436 |
| 3,407,562 | 10/1968 | DiNicola | 53/436 |
| 3,972,155 | 8/1976 | Mahaffy et al. | 53/579 X |
| 4,318,264 | 3/1982 | Rewitzer | 53/528 X |
| 4,685,391 | 8/1987 | Picker | 100/246 X |
| 4,688,369 | 8/1987 | Cornish et al. | 53/436 |
| 4,730,443 | 3/1988 | Matsuda et al. | 53/580 |

FOREIGN PATENT DOCUMENTS

| | | | |
|---|---|---|---|
| 0495693 | 1/1977 | Australia | 53/528 |

*Primary Examiner*—R. L. Spruill
*Assistant Examiner*—Beth Bianca
*Attorney, Agent, or Firm*—Antonelli, Terry, Stout & Kraus

[57] ABSTRACT

A fiber baling press consists of a rugged machine frame with a press ram in most cases movable from the top toward the bottom, a press box being movable underneath the ram. The press box consists of a press box casing which should be closed all around. This press box rests on a press box bottom plate which, in this case, for the pressing step, is simultaneously the lower press platen. The press ram as well as, in particular, the press box bottom plate are to be fashioned in the manner of a trough in order to impart to a piece of packaging material for the upper and lower sides of the bale of fiber a preliminary orientation directed toward the bale, after the press box casing has been pulled off the bale. A special advantage resides in making the bottom plate have a trough-like opening of the press box casing so that overflowing of the compacted fiber material over the four lateral flanges of the trough is avoided after withdrawing the press box casing. The piece of packaging material, e.g. a sheet, is to be aligned in parallel to the bale.

11 Claims, 1 Drawing Sheet

FIBER BALING PRESS

This invention relates to a fiber baling press with at least one press platen that can be covered with a sheet-like piece of packaging material, associated with a press box casing that is preferably closed all around.

A fiber baling press of this type has been known from DOS 2,911,958. Since the steel bands or the like for tying of the bale must not come into contact with the fibers, the bale is to be covered on all sides with packaging material prior to reinforcement. For this purpose, the lower as well as the upper press rams are covered, before the compacting step, with a piece of packaging material; then the bale is compressed, thereafter the press box casing, while maintaining the compacting pressure, is pulled off in the upward direction, and finally, to end the packaging step, the bale is wrapped all around with a wider piece of packaging material in the horizontal direction.

A prerequisite for satisfactory packaging is not only that the packing material covers the bale all around, but also that this material surrounds the bale without any creases so that the faces as well as the edges of the bales have a cleanly packaged appearance. In order to attain this objective, it is known from the aforementioned laid-open application to make the press ram, as well as the press box bottom, of a core ram and an outer ram surrounding the former so that, after the compacting step, upon removal of the outer ram, the edge pieces of a sheet packaging material can be uniformly placed about the bale. This press ram structure is very expensive with respect to its production. However, it also requires a number of movement processes solely for the mere packaging of the bale all around with a sheet; these are rather time-consuming and, in the final analysis, also susceptible to trouble. In this regard, it is more advantageous of the bottom of the press box and the press ram are not subdivided but, rather, are each made of one piece. However, in such a case, devices must be provided in the upper as well as lower press rams which, after the compression step, bend the outwardly projecting edge sections of the pieces of packaging material at the bottom and at the top toward the bale. These edge sections which then, as desired, are in contact with the bale, are finally covered with the horizontally wrapped-around sheet so that the bale is completely and smoothly packaged all around.

As is known from DOS 2,911,958, the lower press ram, i.e. the bottom plate of the press box, consists of a planar platen penetrated by wrapping grooves for the reinforcing step. Devices are arranged in the bottom plate outside of the cross section of the compacted bale, i.e. in the zone of the press box casing set down on the bottom plate, which are to effect the turning over of the marginal sections of the packaging sheet in the upward direction about the bale, after the press box casing has been withdrawn in the upward direction. These devices consist of fingers which are to shift the edge sections of the sheet all around in the upward direction. It has been found that these edge zones of the sheet, urged during the pressing step of the bale by the lower end face of the press box casing firmly against the bottom plate, can be placed by these fingers, upwardly against the bale only with difficulties. This is perhaps possible in the region of the longer side faces of the bale, even though it also happens here that the fingers penetrating from the bottom toward the top from the bottom plate will pass through the sheet, making an alignment of the marginal sections impossible. In any event, in the region of the corners, these fingers cannot bring the sheeting, present in excess at those locations, into contact with the bale. It happens time and again that precisely at, the corners the sheeting will form a kind of ear projecting in opposition to the contacting direction downwardly away from the bale.

The invention is based on the object of developing a fiber baling press wherein the sheet of packaging material, on account of the configuration of the press platen, will be caused to automatically enter into contact on its own with the bale after withdrawal of the press box casing, whereby fingers that are stretching, are to be pivoted, or are to be shifted upwardly are essentially avoided.

Starting with the fiber baling press of the type heretofore described above, the thus-posed problem is solved by fashioning the press platen, for alignment of the sheeting, in the manner of a trough with wall sections which project all around with respect to the bottom.

On account of this measure, the marginal sections of the sheet of packaging material are oriented upwardly during filling of the press box with the fiber material to be compacted. A portion of the marginal sections of the sheet is thus already oriented in the upward direction upon the withdrawal of the press box casing, so that the remaining marginal sections of the sheet, bent downwardly by the lower end face of the press box casing, will be automatically oriented in the upward direction after withdrawal of the press box casing. The same also holds true for the upper press ram, but in this instance, the sheeting will align itself automatically in the downward direction.

During the compacting of the fiber material, a force is also generated in the direction toward the press box walls due to the compacting pressure acting perpendicularly in the downward direction. This pressure is released upon withdrawal of the press box casing whereupon the fiber material, depending on the fiber properties, will expand toward the outside by one or two centimeters. If, now, the press box casing is withdrawn, then the fiber material will bulge along the top edge of the trough beyond this edge toward the outside and thus the sheet is urged horizontally outwardly by the tendency oriented from the bottom toward the top. A special idea of this invention resides in avoiding this horizontal outward curving of the sheet, by making the bottom plate in its trough-like cross section larger than the cross-sectional area of the press box casing. If, now, the press box casing is withdrawn, the fiber material will expand not only in the zone of the press box casing, previously located at that point, toward the outside, but also in the region of the trough-shaped opening of the bottom plate, namely precisely in such a way that, after termination of the expansion process, the bale has exactly the shape already exhibited by the trough in its structure. Consequently, the sheet is in contact perpendicularly with the bale uniformly oriented upwardly from the planar surface, and can then be readily covered by the sheeting to be wrapped around horizontally, without the need for additional guide fingers or the like.

Another, very advantageous measure is afforded if the lower end of the inner wall of the press box casing dips into the trough. In this case, after placing the sheet on the bottom plate, during joining of the press box casing with the bottom plate, the sheet is already at this point in time urged uniformly all around into the depth of the bottom plate so that even after the press box casing, reunited with the bottom plate, is transported away, a shifting of the sheet section is no longer possible.

An automatic alignment of the sheet edge sections on the bales is, of course, possible by the feature of this invention only if the marginal sections of the sheet are not too long and too heavy. This holds true especially for the longer longitudinal sides of the bale which later on are retained by the steel bands or the like. However, along the narrower end faces, which are generally not reinforced, a longer sheet section is necessary in order to cover the bale permanently with the sheeting. This longer sheet section, however, cannot be oriented upwards by the measure of this invention over its entire length on account of its weight. In order to make this yet possible in the construction of this invention, the invention provides that a sheet laying plate is mounted to be displaceable in the upward and downward directions on the outside of the two narrow sides of the bottom plate, in close proximity to the outer wall. Thus, no fingers are to be fastened to the bottom plate; rather, merely a pivotable sheet laying plate is to be provided which can be moved through an oblique plane, for example, when moving the compacted bale into a reinforcing station.

The drawings illustrate an embodiment of the structure of the lower press platen, which is simultaneously or which comprises the bottom of the press box of a fiber baling press.

Figure 1:
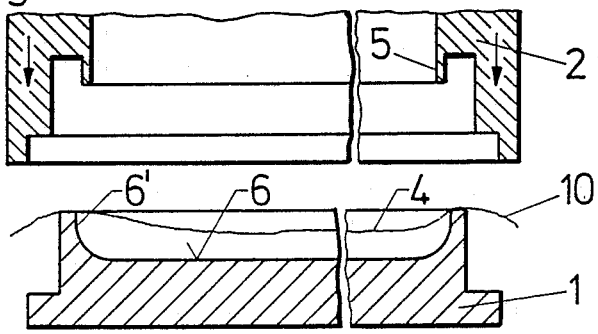
FIG. 1 shows the press platen in a sectional view transversely to the longitudinal extension of a bale to be compressed with the press box casing positioned thereabove.

In the fiber baling press according to the invention, the lower press platen of a central press (see FIG. 1) also comprises the bottom plate 1 of a press box. The press box thus consists of the bottom plate 1 and the all-around closed press box casing 2 detachably joined to the bottom plate 1. The bottom plate 1 has wrapping grooves 3 to pull through the packaging strings or the like, as can be seen from FIG. 4; these grooves are open toward the bale 9 so that the threaded straps, strings or the like, after the compacting pressure is eliminated, are placed through these openings against the bale. As can be seen from FIGS. 1–3, the bottom plate 1 has an upper potion or section fashioned in the shape of a trough in a zone cooperating with the feeding site for the fiber material 7, this configuration serves not only to impart to the bale 9 a rounded shape in the region of the longitudinal rims, but also in order to impart to the piece of packaging material 4 (e.g. a sheet of plastic material) a preliminary orientation upwardly in the direction toward the bale 9; this piece of packaging material, for covering the bale 9 on its underside, is placed on the press platen 1 by means of devices, that are not shown herein, prior to uniting the platen with the press box casing 2. Suitably, inner surfaces of the rims or walls 6′ of the trough 6 are equipped with an inner radius. The press ram, not shown, can likewise be fashioned in the manner of a trough open toward the bottom.

Figure 2:
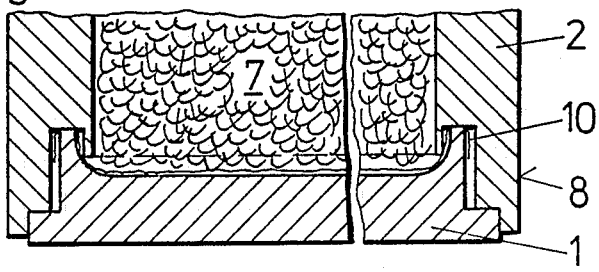
FIG. 2 shows the press platen according to FIG. 1 with the press box casing being connected, for example, after filling with a fiber material that still has to be compacted.

Thus, after the bottom plate 1 has been covered with the piece 4 of the packaging material in accordance with the illustration in FIG. 1, the press box casing 2 travels, coming from above, in the downward direction and rests on the bottom plate 1, to be joined firmly with the plate by hinged means or like fastening means, not shown. As can be seen especially from FIG. 2, the inner surface area of the trough 6 is larger than the cross section of the interior of the press box casing 2. At the same time, with a small spacing with respect to the trough 6, the lower end 5 of the inner wall of the press box casing 2 extends into the trough 6 so that the piece of packaging material 4 is uniformly placed on a bottom surface of the trough form in the bottom plate 1 and is also firmly fixed at that location during filling of the trough with fiber material 7. The outer wall 8 of the press box casing 2, of a more rugged structure, is supported outside of the trough 6 on a flange portion of the bottom plate 1 so that the weight of the press box casing 2 does not rest on the wall 6′ of the trough 6, which wall 6′ has a narrower construction. For this reason, therefore, the press box casing extends outside of the trough 6 and is there joined by means of grippers or other fastening means to the bottom plate 1.

Figure 3:
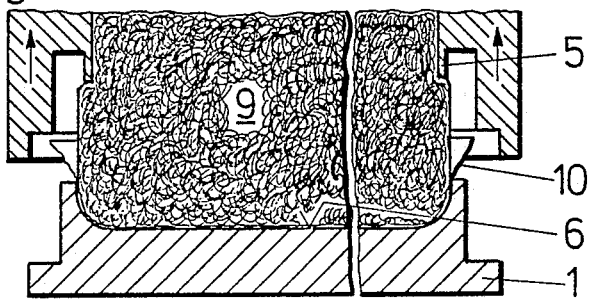
FIG. 3 shows the press platen of FIG. 1 after compacting of the fiber material, the bale still remaining under the compacting pressure, but while the press box casing is being pulled off.

From a rough press, not shown, the press box then travels, together with the fiber-filled press box casing and the press box bottom, i.e. bottom plate, to the central press where the final compacting step for the fiber material to form the bale 9, seen in FIG. 3, is performed. In order to be able to package the bale 9 all around with packaging material, it is necessary to remove the press box casing 2 from the bale 9. This takes place, in the fiber baling press according to this invention by pulling the press box casing away in the upward direction in correspondence with the arrows illustrated in FIG. 3. Since the compacting pressure acts without change on account of the press ram remaining in contact with the bale, the fiber material of the bale 9 will expand toward the sides which are vacant, i.e. free of the casing. In this case, these are the four side faces of the bale 9. Since the cross section of the trough-shaped bottom plate 1 is larger than the cross section of the press box casing 2, the fiber material can also expand in the trough 6 toward all four sides of the trough. This has the advantage that the fiber material of the bale 9 during expansion is not urged over the top edge of the trough 6 and otherwise would press the sheet 4 at that point horizontally toward the outside. On account of the structure of the bottom plate 1, it is rather, possible for the fiber material of the bale 9 to expand outwardly even in the region of the trough 6, and then will assume, after the expansion step, exactly the configuration previously determined by the trough 6. From the sidewalls of the trough 6, the bale 9 thus will then extend perpendicularly upwardly whereby the piece of packaging material 4 obtains an upwardly directed preliminary orientation. This position of the packaging material is likewise illustrated in FIG. 3.

Figure 4:
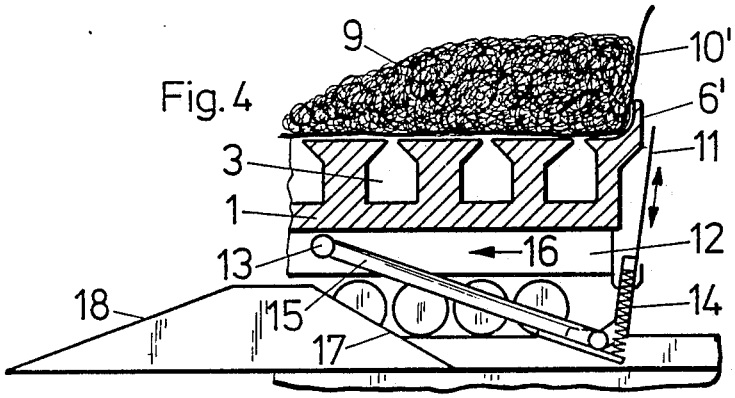
FIG. 4 shows a side elevational view, partially in section, of the press platen during later displacement into a neighboring packaging station.

Of course, this applied only if the piece of packaging material 4 is not too long in its outwardly projecting marginal zones. For the longer lateral faces of the bale 9, the marginal sections 10 need not be too wide because in this zone the fiber material is retained by the straps or wires introduced through wrapping grooves 3. In contrast thereto, the sheet edge sections must be made longer on the two end faces of the bale since here generally reinforcement does not occur. In FIG. 4, one side of the bale 9 is illustrated in the region of the end face of the bale 9. For such a long marginal section 10' of the piece of packaging material 4, the preliminary orientation of the sheet in the upward direction by the configuration of the trough 6 would not be adequate for bringing the packaging material into contact with the bale 9. It is advantageous to place this marginal section 10' against the bale by attaching a sheet laying plate 11 (to be displaceable in the upward and downward directions on the outside of the narrow sides of the bale, not to be reinforced) to the bottom plate 1 in close proximity to the outer wall. The pivot point of the sheet laying plate 11 is provided on the shifting cart 12 at the joint 13. A spring 14 in a linkage arm 15 takes care of providing constant contacting of the sheet laying plate 11 against the bale 9. Upon a lateral shifting of the press box (1, 2) in the direction of the arrow 16, the linkage arm 15 also passes over the fixedly located, oblique plane 17. Thus the linkage arm 15 is automatically pivoted about the joint 13 upwardly during shifting of the bale into the packaging station whereby the sheet laying plate 11 displaces or moves the marginal section 10' of the piece of packaging material 4 upwards, namely against the end face of the bale 9. The sheet laying plate 11 can also be in contact with the bale 9 during the reinforcing step, without interfering with this reinforcing step. After termination of this packaging procedure, the linkage arm 15 then travels gradually over the downwardly extending, oblique plane 18 on the opposite side and is thereby pulled out of the space between the sheet section 10 and the piece of sheeting that in the meantime has been wrapped around horizontally and again welded in place.

What is claimed is:

1. A fiber baling press comprising a press box comprised of a press box casing that is closed all around and a press platen that can be covered with a sheet-like piece of packaging material, said press platen having means for aligning the piece of packaging material, said means including a trough with wall portions projecting all around with respect to the bottom of the trough; a bottom plate of said press box comprising said press platen, said plate being detachably joined to the press box casing and having an upper portion defining said trough with a cross-sectional area larger than the cross-sectional area of an interior space defined by the press box casing; a lower end of an inner wall of the press box casing extending into the trough and a lower end of an outer wall of the press box casing extending beyond the trough to contact a flange portion of the bottom plate.

2. A fiber baling press according to claim 1, wherein the lower end of the inner wall of the press box casing is arranged at a lateral and perpendicular spacing from the trough-shaped bottom plate when the press box casing is joined to the bottom plate.

3. A fiber baling press according to claim 1 or 2 wherein a sheet layer plate is provided for placing a marginal section of the piece of packaging material along a side of a compacted bale of fibrous material located within said press box casing, said sheet layer plate being displaceable in the upward and downward directions, being arranged outside of two narrow sides of a compacted bale located within the press box casing, which sides are not to be reinforced, and on the bottom plate in close proximity to an outer wall.

4. A fiber baling press according to claim 3 wherein said bale in the compacted condition, is adapted to be laterally shiftable into a packaging station for a final all-around packaging with a sheeting material and with retaining straps, characterized in that the sheet laying plate is pivotably retained on the underside of a shifting cart by way of a pivot lever and upward and downward movement of the sheet layer plate is effected by an element having an oblique plane arranged fixedly along a shifting route of the bale.

5. A fiber baling press which comprises a press box for forming a compacted bale of fibrous material, said press box comprising a press box casing and a press platen, said press box casing being closed around all sides with vertically extending walls and being vertically movable downwardly to an operative position resting on the press platen and upwardly to an inoperable position spaced from said press platen; said press platen being adapted to be covered with a sheet-like piece of packaging material for said bale and having means for aligning the piece of packaging material upwardly around lower side portions of a bale, said means including a trough having a bottom portion and wall portions projecting upwardly all around with respect to the bottom portion of the trough and lower end portions of each of the vertical walls of said press box casing each comprise an inner wall that extends downwardly into the trough and an outer wall that extends outside of the wall portions of the press platen, said outer wall contacting a flange portion of the press platen when the press box casing is resting on the press platen in the operative position.

6. A fiber baling press according to claim 5, wherein said wall portions including curved wall sections that impart a rounded shape to the lower side portions of the bale.

7. A fiber baling press according to claim 5, wherein the inner wall is shorter than the outer wall portions of the press platen so that an end of the inner wall is upwardly spaced from the bottom of the trough to place the piece of packaging material on a bottom surface of the trough and an upper marginal portion of the piece of packaging material is held between a top end of a projecting wall portion of the press platen and a lower end of a vertical wall of the press box casing.

8. A fiber baling press according to claim 5, wherein a lower end of the inner wall of the press box casing is arranged at a lateral and perpendicular spacing from projecting wall portions of the trough in the press platen when the press box casing is supported on the press platen in the operative position.

9. A fiber baling press according to claim 5, further comprising a sheet laying plate provided on the press platen for placing a marginal section of the piece of packaging material along a side of a compacted bale of fibrous material located in said press box casing, said sheet laying plate being displaceable in upward and downward directions, being arranged on outside of two narrow sides of a compacted bale located within said press box casing which are not to be reinforced and being in close proximity to an outer portion of the bale.

10. A fiber baling press which comprises a press box for forming a compacted bale of fibrous material, said press box comprising a press box casing and a press platen, said press box casing being closed around all sides with vertically extending walls and being vertically movable downwardly to an operative position resting on the press platen and upwardly to an inoperable position spaced from said press plate; said press platen being adapted to be covered with a sheet-like piece of packaging material for said bale and having means for aligning the piece of packaging material upwardly around lower side portions of a bale, said means including a trough having a bottom portion and wall portions projecting upwardly all around with respect to the bottom portion of the trough; a sheet laying plate provided on the press platen for placing a marginal section of the piece of packaging material along the side of a compact bale of fibrous material located in said press box casing, said sheet laying plate being displaceable in upward and downward directions, being arranged on outside of two narrow sides of a compacted bale located within said press box casing which are not to be reinforced and being in close proximity to an outer portion of the bale; and said bale in the compacted condition is adapted to be laterally shiftable and the sheet laying plate is pivotably retained on an underside of a shifting cart operatively associated with the press platen by way of a pivot lever and upward and downward movement of the sheet laying plate is effected by an element having an oblique plane arranged fixedly along a shifting route of the bale.

11. A fiber baling press which comprises a press box for forming a compacted bale of fibrous material, said press box comprising a press box casing and a press platen, said press box casing being closed around all sides with vertically extending walls and being vertically movable downwardly to an operative position resting on the press platen and upwardly to an inoperative position spaced from said press platen and said press platen being adapted to be covered with a sheet-like piece of packaging material for said bale; said press platen having means for aligning the piece of packaging material upwardly around lower side portions of a compacted bale within said press box casing, said means including a trough having a bottom portion and wall portions having curved wall sections projecting upwardly all around with respect to the bottom portion of the trough and defining an inner curved surface that extends outwardly beyond surfaces defined by an inner wall of said press box casing; a lower end of said inner wall of the press box casing extending into the trough and an outer end of an outer wall of the press box casing extending beyond the trough to contact a flange portion of the press platen, an upper edge of the trough being covered by a lower edge of the press box casing whereby a compacted bale of fibrous material can expand to conform to the inner curved surface of the trough when the press box casing is moved upwardly to an inoperative position spaced from the press platen and an edge portion of a piece of packaging material aligned on the press platen is caused to project upwardly.

* * * * *